United States Patent [19]

Ciccarelli et al.

[11] 4,396,697

[45] * Aug. 2, 1983

[54] ORGANIC SULFONATE CHARGE ENHANCING ADDITIVES

[75] Inventors: Roger N. Ciccarelli, Rochester; Angelo J. Barbetta, Penfield, both of N.Y.

[73] Assignee: Xerox Corporation, Stamford, Conn.

[ * ] Notice: The portion of the term of this patent subsequent to Nov. 3, 1998, has been disclaimed.

[21] Appl. No.: 327,140

[22] Filed: Dec. 3, 1981

[51] Int. Cl.[3] ..... G03G 9/08

[52] U.S. Cl. ..... 430/108; 430/109; 430/110

[58] Field of Search ..... 430/106, 107, 109, 110

[56] References Cited

U.S. PATENT DOCUMENTS

| | | | |
|---|---|---|---|
| 3,893,935 | 7/1975 | Jadwin et al. | 252/62.1 |
| 3,944,493 | 3/1976 | Jadwin et al. | 252/62.1 P |
| 3,970,571 | 7/1976 | Olson et al. | 252/62.1 P |
| 3,985,664 | 10/1976 | Sakaguchi et al. | 252/62.1 P |
| 4,079,014 | 3/1978 | Burness et al. | 252/62.1 P |
| 4,221,856 | 9/1980 | Lu | 430/110 |
| 4,298,672 | 11/1981 | Lu | 430/110 |
| 4,298,672 | 11/1981 | Lu | 430/108 |

FOREIGN PATENT DOCUMENTS

| | | |
|---|---|---|
| 1181287 | 2/1970 | United Kingdom . |
| 1536514 | 12/1978 | United Kingdom . |

*Primary Examiner*—John E. Kittle
*Assistant Examiner*—John L. Goodrow
*Attorney, Agent, or Firm*—E. O. Palazzo

[57] ABSTRACT

This invention is directed to developer compositions comprised of toner particles and carrier particles, the toner particles being comprised of resin particles, pigment particles, and from about 0.1 to about 10 percent based on the weight of the toner particles of an alkyl pyridinium toluene sulfonate charge enhancing additive of the formula:

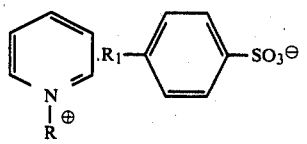

wherein R and $R_1$ are alkyl radicals containing from about 12 carbon atoms to about 25 carbon atoms, which compositions are useful for causing the development of images in electrostatographic imaging systems.

23 Claims, No Drawings

ORGANIC SULFONATE CHARGE ENHANCING ADDITIVES

BACKGROUND OF THE INVENTION

This invention is generally directed to toner compositions and developer materials containing such compositions, as well as the use of these materials in electrostatographic imaging systems, particularly those systems wherein the photoresponsive device utilized has been charged negatively. More specifically, the present invention is directed to developing compositions wherein the toner component is charged positively by certain charge control additives which toner compositions having improved particle to particle uniformity, fast admix charging, narrow charge distributions, improved humidity stability, improved thermal stability, improved resin dispersibility, and improved carbon black dispersion.

The utilization of charge enhancing additives are known in the prior art, these additives being used primarily for the purpose of imparting a positive charge to the toner composition. There is described for example in U.S. Ser. No. 911,623, filed on June 1, 1978, developing compositions comprised of toner particles, carrier particles and as a charge control additive an alkyl pyridinium halide. Also there is disclosed in U.S. Pat. No. 3,893,935 the use of certain quaternary ammonium compounds as charge control agents for electrostatic toner compositions. According to the disclosure of this patent certain specific quaternary ammonium compounds when incorporated into toner compositions were found to provide a toner which exhibited relatively high uniform and stable net toner charge when mixed with a suitable coated carrier. U.S. Pat. No. 4,079,014 contains a similar teaching with the exception that a different charge control agent is utilized namely a diazo type material.

While some of the above developing compositions are suitable for certain purposes, their solubility in water causes difficulties in uniformly dispersing such materials in toner formulations comprising toner resins and carbon black. Further, some of the prior art charge enhancing additives when incorporated into toner compositions migrate to the toner surface at high relative humidity, and as it is very difficult to disperse or dissolve such compound uniformly in the toner composition there results particle to particle non-uniformity and in some instances wide distribution of electrical charge which is not desired.

There continues to be a need for developing compositions which can be used in imaging systems wherein the photoresponsive member is charged negatively, and more specifically, there continues to be a need for improved toner compositions which are positively charged and contain therein charge enhancing additives which are soluble in organic materials and which are humidity insensitive. Additionally there continues to be a need for toner compositions which will rapidly charge new uncharged toner being added to a developing composition comprised of charged toner particles and carrier particles, which toners are humidity insensitive, and wherein the charge enhancing additive is compatible with the toner resin.

SUMMARY OF THE INVENTION

It is a feature of the present invention to provide a developer composition which overcomes the above-noted disadvantages.

In yet another feature of the present invention there is provided a developer composition which contains positively charged toner particles and carrier particles.

In yet another feature of the present invention there is provided positively charged toner particles containing certain charge enhancing additives which additives are soluble in organic materials, are humidity insensitive, and have improved admix charging.

In an additional feature of the present invention there is provided toner compositions which will develop an electrostatic image containing negative charges on the photoreceptor surface, and which will transfer effectively electrostatically from such photoreceptor to plain bond paper without causing blurring or adversely affecting the quality of the resulting image.

These and other features of the present invention are accomplished by providing dry electrostatic developing compositions comprised of resin particles, pigment particles, carrier particles, and an organic sulfonate charge enhancing additive of the following formula:

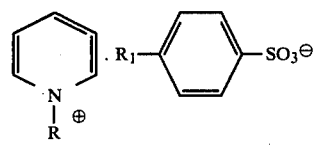

wherein R and $R_1$ are alkyl radicals containing from about 12 carbon atoms to about 25 carbon atoms, and preferably from about 14 carbon atoms to about 20 carbon atoms.

Illustrative examples of alkyl radicals included within the scope of the present invention include tetradecyl, dodecyl, pentadecyl, cetyl, olely, heptadecyl, stearyl, and the like. Preferred alkyl groups for R include cetyl, stearyl and tetradecyl.

Illustrative examples of specific organic sulfonate charge enhancing additives included within the scope of the present invention are cetyl pyridinium dodecylbenzene sulfonate, cetyl pyridinium laurylbenzene sulfonate, cetyl pyridinium cetylbenzene sulfonate, cetyl pyridinium stearylbenzene sulfonate, and the like.

By developer compositions in accordance with the context of the present invention is meant toner particles and carrier particles, the toner particles containing a toner resin, and a colorant, or pigment.

The toner composition of the present invention contains the organic sulfonate charge enhancing additive of the present invention in various amounts, providing that the properties thereof are not adversely affected, and the toner particles are charged positively to an appropriate charge level in comparison to the carrier particles. Generally, the organic sulfoante charge enhancing additive is present in an amount of from about 0.1 percent by weight to 10 percent by weight of toner particles, and preferably from about 0.5 weight percent to about 5 weight percent of the total toner weight. In one preferred embodiment of the present invention, the organic sulfonate charge enhancing additive is present in an amount of from about 0.75 weight percent to about 3.0 weight percent. The sulfonate charge enhancing additive can either be blended in the toner particles or alternatively may be coated on the pigment surface. When the sulfonate is employed as a coating, it is generally present in an amount of from about 2 weight percent to about 20 weight percent, and preferably from about 5 weight percent to about 10 weight percent, based on the weight of the pigment.

Numerous different methods may be utilized for preparing the toner composition of the present invention including for example melt blending the resin and the pigment, coated with the organic sulfonate charge enhancing additive followed by mechanical attrition. Other known methods include for example spray drying, melt dispersion, dispersion polymerization, and emulsion polymerization. In dispersion polymerization a solvent dispersion of resin particles, pigment particles, and the organic sulfonate charge enhancing additive of the present invention are spray dryed under control conditions resulting in the desired product. A toner composition prepared in this manner results in a positively charged toner in relationship to the carrier materials, and these compositions exhibit the improved properties as mentioned hereinbefore.

As the toner resin there can be utilized various suitable resins known in the art, illustrative examples of which include polyamides, epoxies, polyurethanes, vinyl resins, and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of alphamethylene butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being of the formula as shown in column 4, beginning at line 5 of this patent, and the dicarboxylic acid being of the formula as shown in column 6 of the above patent.

The amount of toner resin present depends primarily on the percentage by weight of the organic charge enhancing sulfonate compound that is present, and the percentage by weight of pigment or colorant such as carbon black. Thus, for example, when 5 percent by weight of the charge enhancing sulfonate compound is present, and 5 percent by weight of the pigment or colorant, such as carbon black is present, about 90 percent by weight of resin material is present.

Any suitable pigment or dye may be employed as the colorant for the toner particles, such materials being well known and including for example, carbon black, magnetite, iron oxides, nigrosine dyes, chrome yellow, methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is employed in amounts of from about 3 percent to about 50 percent by weight based on the total weight of toner, however, if the pigment employed is a dye, substantially smaller amounts, for example less than 10 percent by weight, may be used.

Illustrated examples of carrier materials that can be employed in formulating the developing compositions of the present invention, (toner plus carrier) include various known carriers, providing such carrier particles are capable of triboelectrically obtaining a charge of opposite polarity to that of the toner particles. In the present invention in one embodiment that would be a negative polarity, so that the toner particles will adhere to and surround the carrier particles. Thus, the carriers are to be selected so that the toner particles acquire acharge of a positive polarity, and include materials such as ammonium chloride, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. No. 2,618,441; 2,638,522; and 3,533,835. Also nickel berry carriers as described in U.S. Pat. Nos. 3,847,604 and 3,767,598 can be employed, these carriers being nodular carrier beads of nickel characterized by a surface of reoccurring recesses and protrusions providing particles with a relatively large external area. The diameter of the coated carrier particle is from about 50 to about 1,000 microns, thus allowing the carrier to possess sufficient density and inertia to avoid adherence to the electrostatic images during the development process.

The carrier may be employed with the toner composition in any suitable combination, however, best results are obtained when about 1 part by weight to 3 parts by weight of toner is used, to about 10 to about 200 parts by weight of carrier.

Toner compositions of the present invention may be used to develop electrostatic latent images on most suitable electrostatic surfaces capable of retaining charge, including conventional photoreceptor devices, however, the toners of the present invention are best utilized in systems wherein a negative charge resides on the photoreceptor, and this usually occurs with organic photoreceptors. Illustrative examples of such photoreceptors are polyvinyl carbazole, 4-dimethylaminobenzylidene, benzhydrazide; 2-benzylidene-amino-carbazole, 4-dimethylaminobenzylidene, benzhydrazide; 2-benzylidene-aminocarbazole, (2-nitro-benzylidene)p-bromoaniline; 2,4-dimethyl-amino phenyl-benzoxazole; 3-aminocarbazole; polyvinylcarbazole-trinitrofluorenone charge transfer complex; phthalocyanines, layered photoresponsive devices comprised of charge generating layers, and charge transport layers deposited on a substrate, and the like. Examples of charge generating layers include vanadyl phthalocyanine and trigonal selenium, while examples of transfer layers include certain diamines dispersed in a binder. The type of layered photoresponsive devices that can be employed are described in U.S. Pat. Nos. 4,265,990 and 4,251,612, the disclosure of each of these patents being totally incorporated herein by reference.

Accordingly, the present invention in another embodiment is directed to a method of imaging comprising forming a negative electrostatic latent image on an imaging member, contacting the image with a positively charged electrostatic developing composition comprised of toner particles and carrier particles, the toner particles being comprised of resin particles, pigment particles, and from about 0.1 percent to about 10 weight percent, based on the weight of the toner particles of an alkyl pyridinium toluene sulfonate charge enhancing additive of the formula:

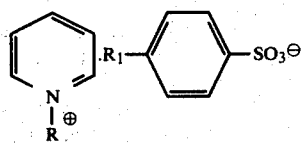

wherein R and $R_1$ are alkyl radicals containing from about 12 carbon atoms to about 25 carbon atoms, and preferably from about 14 carbon atoms to about 20 carbon atoms, followed by transferring the developed image to a suitable substrate, and affixing the image thereto.

The following examples further define the species of the present invention, and these examples are intended to illustrate and not limit the scope of the present invention. Parts and percentages are by weight unless otherwise indicated.

EXAMPLE I

There was prepared the charge enhancing additive cetyl pyridinium dodecyl benzene sulfonate by dissolving 40.80 grams of cetyl pyridinium chloride in 367 milliliters of water, and mixing this solution with 46.9 grams of sodium dodecyl benzene sulfonate, commercially available from Pfaitz and Bauer, Inc., dissolved in 422 milliliters of water. Subsequent to mixing with vigorous stirring the mixture was heated to 90° C. over a period of one hour, and stirring was discontinued. The reaction mixture was allowed to cool and two layers resulted, a bottom layer which was removed, comprised mostly of water, and a top oily layer. There was then added to the oily layer, 600 milliliters of water, followed by vigorous stirring, and heating to 85° C. Stirring was discontinued and the mixture was allowed to cool, subsequent to which two layers resulted, namely a bottom water layer, and a top oily layer. There was again added to the top oily layer after removal of the bottom water layer, 600 milliliters of water followed by vigorous stirring, and heating to 85° C. Stirring was discontinued and the mixture allowed to cool resulting in the formation of a bottom water layer and a top oily layer, followed by removal of the bottom water layer. This procedure of washing with water was repeated about 7 times.

Subsequently, water was removed from the final oil layer obtained by azeotroping with 1-propanol on a Roto Vapor Vacuum Stripper at 55° C. A total of 600 milliliters of 1-propanol was added slowly throughout the vacuum stripping. The resulting product was dryed in a vacuum oven for 24 hours at 40° C., and 65 grams of cetyl pyridinium dodecyl benzene sulfonate of the following formula was isolated in a yield of about 88 percent.

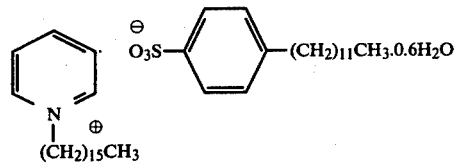

ANALYSIS

| Component | Calculated | Found |
|---|---|---|
| C | 73.08 | 72.82 |
| H | 10.75 | 10.83 |
| N | 2.19 | 2.28 |
| O | 8.99 | 9.05 |
| S | 5.00 | 5.03 |
| % $H_2O$ | 1.69 | 1.42 |

A toner composition was prepared by melt blending followed by mechanical attrition, which composition comprised 1.79 weight percent of the above cetyl pyridinium dodecyl benzene sulfonate, 6 weight percent of Regal 330 carbon black, and 92.21 weight percent of a styrene/n-butylmethacrylate copolymer containing 58 percent by weight of styrene and 42 percent by weight of methacrylate.

The triboelectric charge on this toner was measured against a Hoeganese steel carrier coated with 0.175 percent Kynar 301, a vinylidene fluoride resin commercially available from Penwalt Company at 3 percent toner concentration with the following results:

| Time | Toner Charge, Microcoulombs Per Gram (uc/g) |
|---|---|
| 1 min. | +42 |
| 10 min. | +47 |
| 1 Hr. | +35 |
| 5 hr. | +20 |

-continued

| Time | Toner Charge, Microcoulombs Per Gram (uc/g) |
|---|---|
| 24 Hr. | +14 |

The above prepared developing composition was utilized in a xerographic imaging device employing a negatively charged organic layered photoresponsive device containing an aluminum substrate, overcoated with a trigonal selenium charge generating layer, which is in contact with a transport layer of N,N'-diphenyl-N,N'-bis(3-methylphenyl)-[1,1'-biphenyl]-4,4'diamine dispersed in Makrolon polycarbonate resin commercially available from Mobay Chemical Company, which device was prepared as described in U.S. Pat. No. 4,265,990, and developed images of excellent quality were obtained with high solid area density, and low background.

Other modifications of the present invention may occur to those skilled in the art based on a reading of the present disclosure, and these are intended to be included within the scope of the present invention.

What is claimed is:

1. An electrostatic developer composition comprised of toner particles and carrier particles, the toner particles being comprised of resin particles, pigment particles, and from about 0.1 to about 10 percent based on the weight of the toner particles of an alkyl pyridinium toluene sulfonate charge enhancing additive of the formula:

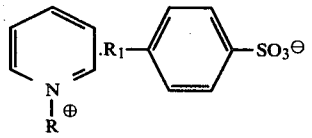

wherein R and $R_1$ are alkyl radicals containing from about 12 carbon atoms to about 25 carbon atoms.

2. A developer composition in accordance with claim 1 wherein R and $R_1$ are alkyl radicals containing from about 14 carbon atoms to about 20 carbon atoms.

3. A developer composition in accordance with claim 1 wherein R is cetyl.

4. A developing composition in accordance with claim 1 wherein the toner resin is a styrene/n-butylmethacrylate copolymer or a styrene butadiene copolymer, and the pigment is carbon black.

5. A developer composition in accordance with claim 4 wherein the styrene/n-butylmethacrylate is comprised of styrene in an amount of 65 percent by weight, and n-butylmethacrylate in an amount of 35 percent by weight.

6. A developer composition in accordance with claim 4 wherein the styrene butadiene copolymer is comprised of styrene in an amount of 91 percent by weight, and butadiene in an amount of 9 percent by weight.

7. A developer composition in accordance with claim 1 wherein the charge enhancing sulfonate additive is cetyl pyridinium dodecyl benzene sulfonate.

8. A developr composition in accordance with claim 1 wherein the charge enhancing additive is cetyl pyridinium laurylbenzene sulfonate.

9. A developer composition in accordance with claim 1 wherein the charge enhancing additive is cetyl pyridinium cetyl benzene sulfonate.

10. A developer composition in accordance with claim 1 wherein the charge enhancing additive is cetyl pyridinium stearylbenzene sulfonate.

11. A developer composition in accordance with claim 1 wherein the carrier consists of a steel core coated with a vinylidene fluoride resin.

12. A developer composition in accordance with claim 1 wherein 3 parts of toner composition to 200 parts of carrier are utilized.

13. A method of developing images which comprises forming a negative electrostatic latent image on an imaging member, contacting the image with a positively charged electrostatic developing composition comprised of toner particles and carrier particles, the toner being comprised of resin particles, pigment particles, and from about 0.1 percent to about 10 weight percent based on the weight of the toner particles of an organic sulfonate charge enhancing additive of the formula:

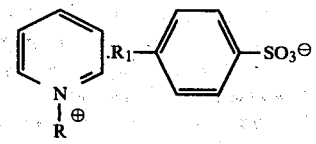

wherein R and $R_1$ are alkyl radicals containing from about 12 carbon atoms to about 25 carbon atoms.

14. A method of imaging in accordance with claim 13 wherein R and $R_1$ are alkyl radicals containing from about 14 carbon atoms to about 20 carbon atoms.

15. A method of imaging in accordance with claim 13 wherein R is cetyl.

16. A method of imaging in accordance with claim 13 wherein the toner is a styrene/n-butylmethacrylate copolymer or a styrene butadiene copolymer, and the pigment is carbon black.

17. A method of imaging in accordance with claim 13 wherein the charge enhancing sulfonate additive is cetyl pyridinium dodecyl benzene sulfonate.

18. A method of imaging in accordance with claim 13 wherein the charge enhancing additive is cetyl pyridinium cetyl benzene sulfonate.

19. A method of imaging in accordance with claim 13 wherein the charge enhancing additive is cetyl pyridinium laurylbenzene sulfonate.

20. A method of imaging in accordance with claim 13 wherein the charge enhancing additive is cetyl pyridinium cetyl benzene sulfonate.

21. A method of imaging in accordance with claim 13 wherein the charge enhancing additive is cetyl pyridinium stearylbenzene sulfonate.

22. An electrostatic developer composition comprised of toner resin particles, wherein the resin is comprised of a styrene/n-butylmethacrylate copolymer or a styrene butadiene copolymer, and carrier particles, consisting of a steel core coated with a vinylidene fluoride resin, pigment particles, and from about 0.1 to about 10% based on the weight of the toner particles of the charge enhancing additive cetyl pyridinium laurylbenzene sulfonate, cetyl pyridinium cetyl benzene sulfonate or cetyl pyridinium stearylbenzene sulfonate.

23. A developer composition in accordance with claim 22, wherein the pigment particles are comprised of carbon black.

* * * * *